US009046011B2

(12) United States Patent
Kujas et al.

(10) Patent No.: US 9,046,011 B2
(45) Date of Patent: Jun. 2, 2015

(54) CAM ELEMENT FOR A VALVE DRIVE TRAIN DEVICE

(71) Applicant: DAIMLER AG, Stuttgart (DE)

(72) Inventors: Michael Kujas, Berlin (DE); Thomas Stolk, Kirchheim (DE); Alexander Von Gaisberg-Helfenberg, Beilstein (DE)

(73) Assignee: Daimle AG, Stuttgart (DE)

( * ) Notice: Subject to any disclaimer, the term of this patent is extended or adjusted under 35 U.S.C. 154(b) by 0 days.

(21) Appl. No.: 14/175,682

(22) Filed: Feb. 7, 2014

(65) Prior Publication Data

US 2014/0150743 A1 Jun. 5, 2014

Related U.S. Application Data

(63) Continuation-in-part of application No. PCT/EP2012/003001, filed on Jul. 17, 2012.

(30) Foreign Application Priority Data

Aug. 9, 2011 (DE) ..... 10 2011 109 764

(51) Int. Cl.

| | |
|---|---|
| ***F01L 1/34*** | (2006.01) |
| ***F01L 1/08*** | (2006.01) |
| ***F01L 1/18*** | (2006.01) |
| ***F01L 13/00*** | (2006.01) |

(52) U.S. Cl.

CPC ..... *F01L 1/34* (2013.01); *Y10T 29/49293* (2015.01); *F01L 1/08* (2013.01); *F01L 1/18* (2013.01); *F01L 13/0036* (2013.01); *F01L 2013/0052* (2013.01)

(58) Field of Classification Search

CPC ..... F01L 1/34; F01L 1/08; F01L 1/18; F01L 13/0036; F01L 2013/0052; Y10T 29/49293

USPC ..... 123/90.16, 90.6, 90.15

See application file for complete search history.

(56) References Cited

U.S. PATENT DOCUMENTS

2008/0236256 A1 10/2008 Yamamoto et al.

FOREIGN PATENT DOCUMENTS

| | | |
|---|---|---|
| DE | 195 19 048 | 11/1996 |
| DE | 10 2007 022 145 | 1/2008 |
| DE | 10 2007 010 148 | 9/2008 |
| DE | 10 2008 036 030 | 2/2010 |
| DE | 10 2008 050 776 | 4/2010 |
| DE | 10 2010 004 591 | 7/2011 |

*Primary Examiner* — Zelalem Eshete

(74) *Attorney, Agent, or Firm* — Klaus J. Bach

(57) ABSTRACT

In a cam element for a valve drive train device of an internal combustion engine having at least one cam comprising at least two partial cams which are arranged next to one another and have a shared base circle phase in at least one angular camshaft range for valve lift switching by displacing their axial position with respect to a cam follower from one of the partial cams to another of the partial cams, the partial cams are angularly displaced in an axially overlapping arrangement. Also, between adjacent partial cams, a circular undercut is formed which has a center that is slightly offset from the rotational axis of the cam element so as to facilitate a switch over of valve actuation from one to another of the adjacent partial cams.

6 Claims, 2 Drawing Sheets

CAM ELEMENT FOR A VALVE DRIVE TRAIN DEVICE

This is a Continuation-In-Part application of pending international patent application PCT/EP2012/003001 filed Jul. 17, 2012 and claiming the priority of German patent application 10 2011 109 764.7 filed Aug. 9, 2011.

BACKGROUND OF THE INVENTION

The invention relates to a cam element for a valve drive train device with cams comprising each at least two partial cams disposed next to one another and having a shared base circle in a particular angular range.

DE 10 2008 050 778 A1 discloses a cam element for a valve drive train device of an internal combustion engine comprising at least one cam that has at least two partial cams which are situated next to one another, have a shared base circle phase in at least one camshaft angular range, and are provided for valve lift switching by displacing a cam follower from one of the partial cams to another of the partial cams.

The object of the present invention is to increase the efficiency of an internal combustion engine.

SUMMARY OF THE INVENTION

In a cam element for a valve drive train device of an internal combustion engine having at least one cam comprising at least two partial cams which are arranged next to one another and have a shared base circle phase in at least one angular camshaft range for valve lift switching by displacing their axial position with respect to a cam follower from one of the partial cams to another of the partial cams, the partial cams are angularly displaced in an axially overlapping arrangement. Also, between adjacent partial cams, a circular undercut is formed which has a center that is slightly offset from the rotational axis of the cam element so as to facilitate a switch over of valve actuation from one to another of the adjacent partial cams.

It is also proposed that the partial cams have a slightly axially and also angularly displaced overlapping arrangement. A valve lift and a valve opening duration or phase angle may thus be advantageously coordinated with a combustion process in a cylinder, so that the combustion process may be thermodynamically improved. Due to a change not only of the valve lift but also the valve opening angle in the overlapping arrangement, an improvement may be made with regard to fuel consumption as well as combustion residues, so that the efficiency of an internal combustion engine may be increased. A "cam element" is understood in particular to mean a portion of a camshaft which forms a cam for actuating a gas exchange valve. The term "cam having partial cams which are situated next to one another" is understood in particular to mean a cam having two partial cams situated next to one another in the axial direction, and which are provided for actuating the same gas exchange valve differently in different discrete switching positions of the cam element. An actuation characteristic of the gas exchange valve is defined by the individual partial cams. The term "displacing a cam follower" is understood in particular to mean that an individual cam follower, which is provided for picking up a cam contour of the partial cams and for actuating the gas exchange valve, and the partial cams are displaced relative to one another along a rotational axis of the cam element, whereby the relative displacement may take place by an axial movement of the cam element while at the same time the cam follower is axially fixed, or by an axial movement of the cam follower while at the same time the cam element is axially fixed. An "overlapping arrangement" is understood in particular to mean that the partial cams in each case lay one above the other only partially; i.e., in any given cross section, the one partial cam only partially covers the other partial cam. An "overlapping arrangement" is understood in particular to mean that none of the partial cams spans an envelope curve in the radial direction within which the second partial cam is completely situated. The term "provided" is understood in particular to mean specially equipped and/or designed.

It is further proposed that the cam element has an undercut which is introduced between the two partial cams, thus enabling simple manufacture of the cam element. An "undercut" is understood in particular to mean an ablation at a rotationally symmetrical inner edge having a specific shape and defined dimensions, which provides the necessary clearance for the tool used during manufacture, and also for the abutting portion during assembly, preferably according to DIN 509. In the present context, "between" is understood in particular to mean that the undercut is spatially situated along the rotational axis, between the partial cams.

The undercut advantageously has a production axis which is offset relative to a rotational axis. A "production axis" is understood in particular to mean a virtual axis which has symmetry, in particular rotational symmetry, with regard to the undercut, at least in partial areas. The term "offset" is understood in particular to mean that the production axis is displaced with respect to the rotational axis, preferably in a direction corresponding to a pressure side or counterpressure side of one of the partial cams.

In addition, it is advantageous for the undercut to have the shape of a truncated cone. A particularly advantageous transition between the partial cams may be achieved in this way. The term "shape of a truncated cone" is understood in particular to mean a shape which at least essentially corresponds to a truncated cone, for example in a longitudinal section through the cam element, whereby the undercut may have a rounded shape compared to a geometrically ideal truncated cone, in particular at the edges. A longitudinal section is understood in particular to mean a section whose section plane extends through the rotational axis or axially parallel to the rotational axis.

It is further proposed that the undercut merges into the partial cams at a flat angle, at least in the base circle phase. Switchability of the cam follower may thus be advantageously obtained. A "flat angle" is understood in particular to mean that an angle which defines a running surface of the cam follower with respect to a surface of the undercut, at least in a transition area between the running surface and the undercut, is less than 45°, preferably less than particularly advantageously less than 35°.

Also proposed is a valve train device having a cam element according to the invention and a valve lift switching unit which is provided for displacing the cam element along its rotational axis. A valve train device having a simple design and high efficiency may be provided in this way.

Moreover, a method is proposed for manufacturing, a cam element for a valve train device of an internal combustion engine, having at least one cam that has at least two partial cams which are situated next to one another, have a shared base circle phase in at least one camshaft angular range, and are provided for valve lift switching by displacing a cam follower from one of the partial cams to another of the partial cams, in particular a method for manufacturing a cam element according to the invention in which an undercut is introduced between the two partial cams. The cam element may thus be manufactured in a particularly simple manner.

The partial cams are preferably individually shaped after the undercut is introduced. Each partial cam may thus be provided with an individual contour. In the present context, "individually" is understood in particular to mean that the running surfaces of the two partial cams are machined separately.

Further advantages result from the following description of the drawings. One exemplary embodiment of the invention is illustrated in the drawings. The drawings, the description, and the claims contain numerous features in combination. Those skilled in the art will also advantageously consider the features individually and combine them into further meaningful combinations.

DESCRIPTION OF A PARTICULAR EMBODIMENT

Figure 1:
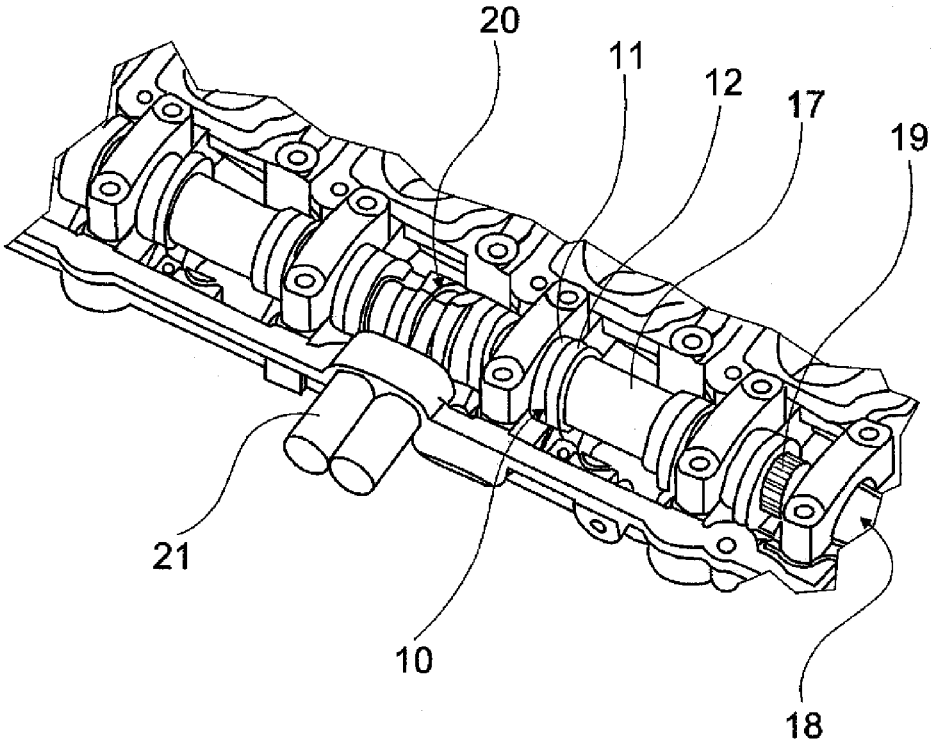
FIG. 1 shows a perspective illustration of a valve drive train device having a cam element according to the invention.
Figure 2:
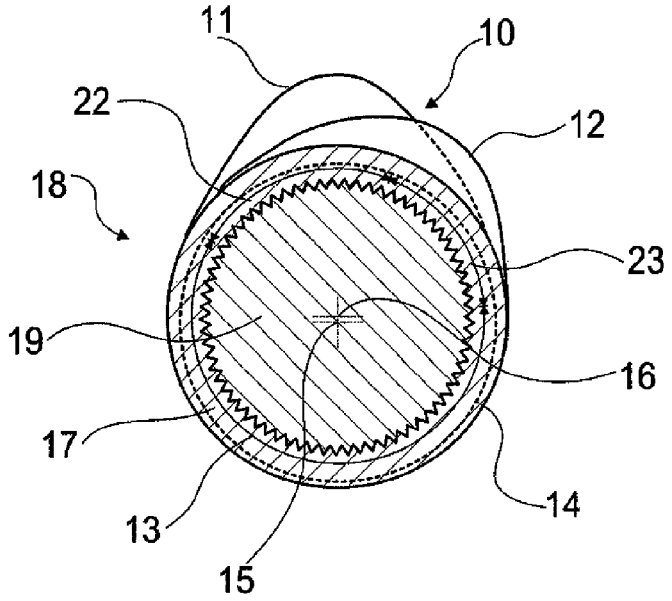
FIG. 2 shows the cam element in an axial view with the camshaft shown cross-section.
Figure 3:
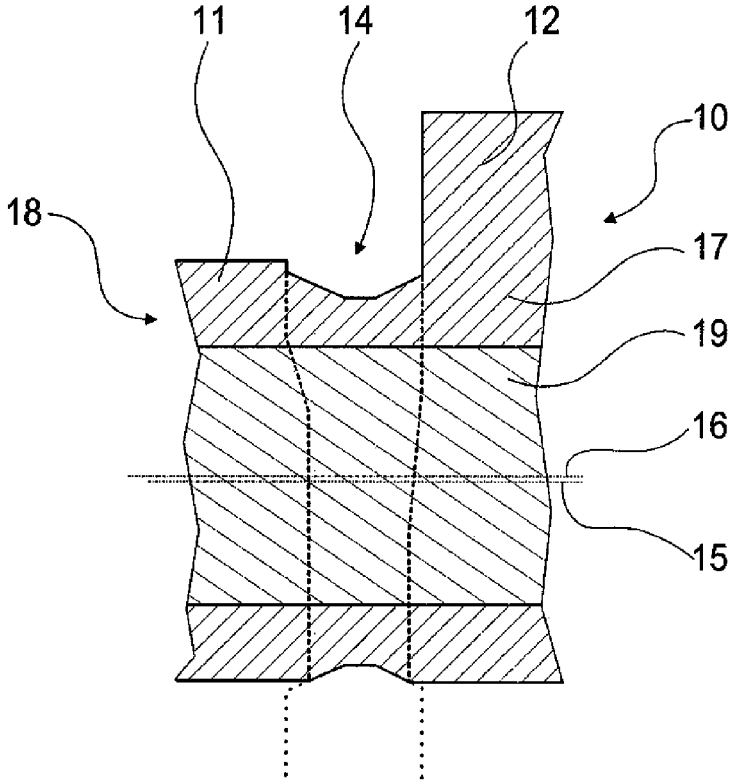
FIG. 3 shows the cam element in an axial cross-sectional view.

FIGS. 1 to 3 schematically show an internal combustion engine valve drive train device having a cam element 17 according to the invention. The internal combustion engine valve drive train device is provided for an internal combustion engine which has at least two cylinders which are arranged in a row and have different valve actuation times. However, the internal combustion engine valve drive train device is also usable for an internal combustion engine in which three, four, or more cylinders are arranged in a row, for example an in-line engine having four cylinders, or a V engine having six cylinders.

The internal combustion engine valve drive train device includes a camshaft 18 provided with a cam element 17 as well as a further cam element having an analogous design. The cam element 17 is in the form of a as a cam support sleeve. A cam 10 comprising two partial cams 11, 12 with different cam contours is situated on the cam element 17. The cam element 17 also has a further cam of an analogous design. The partial cams 11, 12 of the cam 10 are situated directly adjacent to one another. The cam element 17 is axially displaceable. A switch is made from the one partial cam 11, 12 to the other partial cam 11, 12 by axially displacing the cam element 17 and, together therewith, the cam 10. The cam element 17 thus has two discrete switching positions in which a different valve lift is provided for the cylinder or cylinders associated with the element 17.

The camshaft 18 includes a drive shaft 19 for mounting of the cam element 17. The drive shaft 19 includes a crankshaft connection for connecting to a crankshaft, not illustrated in greater detail. The crankshaft connection may be provided via a camshaft adjuster which is provided for setting a phase position between the camshaft 18 and the crankshaft.

The cam element 17 is axially displaceable on the drive shaft 19 in a rotationally fixed manner. The drive shaft 19 has spur toothing on its outer periphery. The cam element 17 has corresponding spur toothing on its inner periphery which engages with the spur to thing of the drive shaft 19.

In addition, the internal combustion engine valve drive train device includes a switch gate 20. The switch gate 20 is provided for sequentially displacing the cam element 17 and the further cam element one after the other in a switching operation. The switch gate 20 includes two gate tracks for displacing the cam element 17. The first gate track is provided for displacing the cam element 17 and the second cam element along a first switching direction from the first switching position to the second switching position. The second gate track is provided for displacing the cam element 17 and the second cam element along a second switching direction from the second switching position into the first switching position (see FIG. 1).

Furthermore, the internal combustion engine valve drive train device includes a switching unit 21 which has two switch pins for engaging with the gate tracks. The switching unit 21 has a stator housing which is fixedly connected to an engine block of the internal combustion engine. The switch pins are situated in the stator housing so as to be displaceable along their main direction of extension. The gate tracks are designed as grooves in which the switch pins may be forcibly guided on both sides. During a switching operation in the first switching direction, the first switch pin is brought into engagement with the first gate track. During a switching operation in the second switching direction, the second switch pin is brought into engagement with the second gate track.

The gate tracks have an axial inclination, at least in partial areas. When one of the switch pins is engaged with the corresponding gate track, a rotation of the cam element 17 about its rotational axis 16 causes the switch pin to exert an axial acting force on the cam element 17, which results in displacement of the cam element 17 along the rotational axis 16. An engagement of a cam follower which is provided for picking up the cam contour is thus moved from the one partial cam 11, 12 to the other partial cam 11, 12. In an actual embodiment, preferably the cam follower is axially fixed and the cam element 17 is axially displaceable. In principle, however, it is also conceivable for the cam element 17 to have an axially fixed design and the cam follower to have an axially displaceable design.

The two partial cams 11, 12 have a shared base circle phase in a camshaft angular range 13. In the shared base circle phase, which is provided for the valve lift switching, the cam follower is moved from the one partial cam 11, 12 to the other partial cam 11, 12. In the shared base circle phase, the two partial cams 11, 12 have essentially the same radial extension with regard to the rotational axis 16 of the cam element 17.

The partial cams 11, 12 of the cam 10 have an overlapping arrangement, wherein in particular the tops of the partial cams are angularly displaced. In at least one angular camshaft range 22 of the camshaft 18, the first partial cam 11 has a radial extension that is larger than a radial extension of the second partial cam 12 in the camshafts angular range 22. In the angular camshaft range 22, a valve lift provided by the first partial cam 11 is greater than a valve lift provided by the second partial cam 12. In an angular camshaft range 23 of the camshaft 18 which is contiguous to the first angular camshaft range 22, the second partial cam 12 has a radial extension which is greater than a radial extension of the first partial cam 11 in the camshaft angular range 23. In this camshaft angular range 23, a valve lift provided by the second partial cam 12 is greater than a valve lift provided by the first partial cam 11. Thus, the second partial cam 12 does not lie completely within a radial envelope curve of the first partial cam 11. Conversely, neither does the first partial cam 11 lie in a radial envelope curve of the second partial cam 12.

Due to the manufacturing process, the cam element 17 has an undercut 14 which is introduced between the two partial cams 11, 12. The undercut 14 is introduced into the cam element 17 using a metal cutting process, in particular a milling and/or turning process. The undercut 14 extends over the entire outer periphery of the cam element 17, and is introduced into the outer periphery of the cam element 17 as an external undercut.

The undercut 14 has a manufacturing axis 15 which is offset with respect to the rotational axis 16 of the cam element 17. The undercut 14 has symmetry with regard to the manufacturing axis 15. At least in the camshaft angular range 13 of the base circle phase, the undercut 14 is rotationally symmetrical with regard to the manufacturing axis 15; i.e., in the camshaft angular range 23 of the base circle phase, the undercut has a base circle whose centerpoint lies on the manufacturing axis 15. During manufacture, the cam element 17 is rotated about the manufacturing axis 15 which extends parallel with respect to the rotational axis 16 but is slightly spaced therefrom.

The undercut 14 has the shape of a truncated cone. In the region of the base circle of the undercut 14, a surface of the cam element 17 extends parallel to the manufacturing axis 15. At the side, at least in the base circle phase, the undercut 14, merges into the partial cams 11, 12 at a slight angle, i.e., an angle is formed between a running surface of the partial cams 11, 12 provided for the cam follower and the surface in the region of the undercut 14, which angle is always less than 45°. The angle is preferably between 10° and 30°.

During manufacture of the cam element 17 from a blank, initially the undercut 14 is provided between the two partial cams 11, 12. The undercut 14 is formed by a metal cutting process. In principle, however, it would also be conceivable to form the undercut 14 by a shaping or forming process, for example directly during manufacture of the blank.

After the undercut 14 is completed, the two partial cams 11, 12 are individually shaped. Simultaneous shaping of the two partial cams 11, 12, for example simultaneous grinding of the running surfaces of the two partial cams 11, 12 in the area of the base circle phase, is dispensed with. After the undercut 14 is completed, the partial cams 11, 12 are individually ground using grinding tools having a width which is only slightly larger than the width of the individual partial cams 11, 12. The order in which the partial cams 11, 12 are ground is arbitrary.

LIST OF REFERENCE NUMERALS

10 Cam
11 Partial cam
12 Partial cam
13 Camshaft angular range
14 Undercut
15 Production axis
16 Rotational axis
17 Cam element
18 Camshaft
19 Drive shaft
20 Switch gate
21 Switching unit
22 Camshaft angular range
23 Camshaft angular range

What is claimed is:

1. A cam element (17) for a valve drive train device of an internal combustion engine having at least one cam structure (10) that comprises at least two partial cams (11, 12) which are situated next to one another and have a shared base circle phase in at least one camshaft angular range (13) provided for valve lift switching by displacing the axial position of the cam structure (10) with respect to a cam follower from one of the partial cams (11, 12) to another of the partial cams (11, 12), the partial cams (11, 12) being disposed on the cam element (17) in an angularly-displaced but, in an axial view, overlapping arrangement, with an undercut (14) being formed between adjacent partial cams (11, 12), the undercut (14) having a manufacturing axis (15) which is offset relative to a rotational axis (16) of the cam element (17).

2. The cam element according to claim 1, wherein the undercut (14) has areas with the shape of a truncated cone.

3. The cam element according to claim 1, wherein the undercut (14) merges into the partial cams (11, 12) at a flat angle, at least in the base circle phase.

4. A valve drive train device with a cam element (17) according to claim 1, and a valve lift switching unit which is provided for displacing the cam element (17) along its rotational axis (16) for changing the valve lift provided by the cam element.

5. A method for manufacturing a cam element (17) for a valve drive train device of an internal combustion engine, the cam element having at least one cam (10) that has at least two partial cams (11, 12) which are situated next to one another and have a shared base circle phase in at least one camshaft angular range (13) provided for valve lift switching by displacing their axial position with respect to a cam follower from one of the partial cams (11, 12) to another of the partial cams (11, 12), said method comprising the step of forming a circular undercut (14) between the two partial cams (11, 12), which undercut has a center that is slightly offset from the axis of rotation of the camshaft.

6. The method according to claim 5, wherein, after completion of the undercut (14), the partial cams (11, 12) are individually machined to the desired shape.

* * * * *